US010682581B2

(12) United States Patent
Bach et al.

(10) Patent No.: US 10,682,581 B2
(45) Date of Patent: Jun. 16, 2020

(54) TOY BUILDING ELEMENT

(71) Applicant: OCTAVIO APS, Aarhus C (DK)

(72) Inventors: Erik Bach, Billund (DK); Flemming Wittrup, Humlebæk (DK)

(73) Assignee: OCTAVIO APS, Aarhus C (DK)

( * ) Notice: Subject to any disclaimer, the term of this patent is extended or adjusted under 35 U.S.C. 154(b) by 0 days.

(21) Appl. No.: 16/322,317

(22) PCT Filed: Jul. 13, 2017

(86) PCT No.: PCT/DK2017/050239
§ 371 (c)(1),
(2) Date: Jan. 31, 2019

(87) PCT Pub. No.: WO2018/024304
PCT Pub. Date: Feb. 8, 2018

(65) Prior Publication Data

US 2019/0184302 A1 Jun. 20, 2019

(30) Foreign Application Priority Data

Aug. 1, 2016 (DK) ..... 2016 00454

(51) Int. Cl.
*A63H 33/08* (2006.01)
*A63H 33/06* (2006.01)
*A63H 33/00* (2006.01)

(52) U.S. Cl.
CPC ..... *A63H 33/062* (2013.01)

(58) Field of Classification Search
CPC ..... A63H 33/00; A63H 33/08; A63H 33/086; A63H 33/088; A63H 33/062; A63H 33/04
(Continued)

(56) References Cited

U.S. PATENT DOCUMENTS 3,005,282 A 10/1961 Christiansen
3,566,531 A 3/1971 Hasel et al.
(Continued)

FOREIGN PATENT DOCUMENTS

CN 102784485 A 11/2012
EP 0891797 A1 1/1999
(Continued)

OTHER PUBLICATIONS

International Search Report for corresponding International Application No. PCT/DK2017/050239 dated Nov. 1, 2018.
(Continued)

*Primary Examiner* — Kien T Nguyen
(74) *Attorney, Agent, or Firm* — Renner, Otto, Boisselle & Sklar, LLP

(57) ABSTRACT

A toy building element comprising primary coupling means that extend from a top wall and comprise a cavity that contains secondary coupling means that are configured for being able to cooperate frictionally with the primary coupling means on a neighbouring element in a number of friction areas. According to the invention there are also primary locking means that are situated at the end of notches in the primary coupling means, wherein the locking means are configured for snap-lockingly engaging with secondary locking means in the cavity of a neighbouring element in same locking areas that are situated outside said friction areas, in which the secondary locking means are elastically resilient in directions in parallel with the top wall of the building element and are substantially elastically relieved in an interconnected position. The coexistence of friction- and snap-locking means entails is that the element yields a far higher coupling force than the known elements, that cold flow is almost eliminated, and that the element is compatible with the known elements.

22 Claims, 9 Drawing Sheets

(58) Field of Classification Search
USPC ..... 446/120–128
See application file for complete search history.

(56) References Cited

U.S. PATENT DOCUMENTS

| | | | | |
|---|---|---|---|---|
| 6,050,873 | A * | 4/2000 | Reisman | A63H 33/062 446/121 |
| 8,495,850 | B1 * | 7/2013 | Lin | E04B 2/18 52/592.6 |
| 9,333,438 | B2 * | 5/2016 | Lee | A63H 33/086 |
| 2014/0244018 | A1 | 8/2014 | Bach et al. | |
| 2014/0308872 | A1 | 10/2014 | Petillo | |

FOREIGN PATENT DOCUMENTS

| | | | |
|---|---|---|---|
| EP | 2949372 | A1 | 12/2015 |
| GB | 1492354 | A | 11/1977 |
| WO | 8601342 | A1 | 2/1986 |
| WO | 8601343 | A1 | 2/1986 |
| WO | 2007085207 | A2 | 8/2007 |

OTHER PUBLICATIONS

Written Opinion of the International Searching Authority for corresponding International Application No. PCT/DK2017/050239 dated Nov. 1, 2018.
Search Report for corresponding Danish Application No. PA201600454 dated Jan. 11, 2017.
International Preliminary Report on Patentability for corresponding International Application No. PCT/DK2017/050239 dated Feb. 5, 2019.

* cited by examiner

TOY BUILDING ELEMENT

This application is a national phase entry of International Application No. PCT/DK2017/050239 filed on Jul. 13, 2017 and published in the English language, which claims priority to Danish Application No. PA201600454, filed Aug. 1, 2016, both of which are hereby incorporated by reference.

The invention relates to a toy building element in the form of a box-shaped hollow body which is defined by a top wall and by walls extending from the one side of the top wall; and wherein, from the opposite side of the top wall, primary coupling means extend that have predetermined contours and location pattern; and wherein, in the box-shaped hollow body, secondary coupling means are provided that are configured to cooperate with the primary coupling means on a corresponding building element in a number of coupling areas; wherein the secondary coupling means comprise secondary locking means in the form of locking protrusions on the walls at a distance from the top wall for snap-lockingly cooperating in snap-coupling areas with primary coupling means on said corresponding building element in a mutually interconnected position.

A building element of this kind is known eg from U.S. Pat. No. 3,005,282. This prior art building element from a world-renowned manufacturer has more recently been subject to further development and patented with great success. This is due to the fact that the primary coupling means provide a fiction coupling against the element's sidewalls and interior coupling tubes, wherein the friction coupling is based on the elastic resilience of the walls. Any elastic deformation entails cold deformation which will entail that the coupling force becomes increasingly loose over time. The prior art technique attempts to obviate this by using high-quality plastics types. In the prior art, a sufficient wall thickness is also required to achieve sufficient coupling force, and finally high requirements are made to the accuracy of the moulding tools to achieve a well-defined coupling force. Therefore, those elements are expensive to manufacture.

This complex of problems is described in eg U.S. Pat. No. 3,566,531, GB 1,492,354, and EP 0 891 797 A1. The solutions known therefrom consist in replacing the friction coupling with some kind of snap-lock coupling.

However, the latter known solution has several drawbacks which, in practice, make it unsuitable both during manufacture and during use.

The prior art technique known from eg U.S. Pat. No. 3,566,531 comprises primary coupling means that have a round-going, protruding bead. This element cannot be injection-moulded, the bead preventing withdrawal of the moulding tool, at least if the element is to have a dimensional stability and hence a quality which corresponds approximately to elements of the type that is known from the above-referenced U.S. Pat. No. 3,005,282. The dimensional stability is also necessary in order for the snap-lock to provide the requisite holding power. The invention takes its starting point in the latter reference, wherein the primary coupling means are substantially inelastic and therefore cannot be moulded as anticipated in the prior art technique taught in U.S. Pat. No. 3,566,531 which corresponds completely to the prior art technique taught in EP 0 891 797 which explicitly excepts rigid plastics as a possible choice of material. Correspondingly, the invention also dissociates itself from the prior art technique taught in US 2014/0308872 which comprises elastically resilient, primary coupling means, but wherein the corresponding locking means in the cavities of the building elements cannot be injection moulded.

The prior art technique taught in eg U.S. Pat. No. 3,566,531 is associated with another considerable drawback. It cannot be interconnected with the prior art known from U.S. Pat. No. 3,005,282 which, as mentioned above, enjoys worldwide renown.

It is the object of the invention to provide a toy building element which, at one go, solves all of the above problems, by providing:

- Increased and more long-term stable coupling force compared to that which is known from elements based on friction forces;
- Interconnectivity with elements that are based on friction forces, eg of the type known from U.S. Pat. No. 3,005,282;
- Quick and inexpensive manufacture, eg by injection moulding.

These objects are obtained by a combination of:

said coupling areas comprising coupling areas that are configured for friction coupling, wherein the coupling areas for friction coupling are situated at a distance from the coupling areas for snap-lock coupling;

said snap-lock coupling being provided by means of, on the one hand, said locking protrusions and, on the other, primary locking means that are situated at the end of notches in the primary coupling means; and said locking protrusions being substantially elastically relieved when the element is interconnected with said corresponding building element.

This kind of primary locking means does not prevent interconnection with elements of the type that is known from U.S. Pat. No. 3,005,282, and the element according to the invention can be injection moulded by means of a simple core in the moulding tool which delimits both the primary locking means and the notches in the primary coupling means. It has been found with the present invention that the locking protrusions can be defined only by means of a core which, at the same time, leaves behind notches in the primary coupling means. The deeper the notches, the larger the material thickness imparted to those parts of the core that delimit the locking protrusions.

It is a break from the earlier mind-set when the invention sets forth that both coupling principles should coexist. The invention is also based on the discovery that it is possible to configure the areas for friction coupling and snap-lock coupling, respectively, in mutually separate areas so as to prevent them from obstructing each other's function. Therefore, the invention is not limited by said walls extending from the top wall having to be the element's side or end walls; rather it applies that the walls could also be coupling skirt tubes having a given cross-sectional shape or they could be local protrusions in the cavity of the element.

The snap-lock according to the invention supplements or almost replaces the friction coupling, and consequently reduces the requirements made to types of plastics, the wall thickness and the accuracy of the tools, whereby the manufacture of the element becomes cheaper. Owing to the widespread use of the prior art elements, it is a major advantage—from a commercial point of view—that the element according to the invention can be interconnected with the known elements.

Thus, the invention entails a combinatorial effect, viz that the elements can be manufactured more inexpensively, exhibit an increased holding force and be interconnected with the known elements. Finally, the cold-flow issue has been resolved in that the plastics material is substantially relieved in the mutual locking position. Thereby no particular demands are made to the choice of material.

The elements according to the invention can be injection moulded, but are also suitable for 3D manufacturing. Those plastic types that are the most suitable ones for 3D manufacturing can be used without there being, as a consequence of cold flow, any risk of a poor building experience. 3D manufacturing is a technology in rapid development, and the element according to the invention is also suitable for quick 3D manufacturing; less requirements being made, as set forth above, to both wall thicknesses and to accuracy.

Environmental considerations receive increasing attention. In connection with toy building elements, it may be substances in the plastics that are harmful to the children, or it may be the disposal of the elements, or a raw material/oil issue in connection with the manufacture and the cost of manufacture. According to the invention, a high degree of freedom is provided as to the choice of plastics types thus enabling a prioritization of environmental considerations.

The notches being defined between a number of ribs extending between the top wall and a top disc constituting the top of the primary coupling means, said ribs being situated on or within an axial extension of the contour of the top disc, substantial material savings are accomplished and so is quicker manufacture due to the element cooling faster during the moulding process.

The ribs may extend radially relative to the primary coupling means or they may be curved cylindrical sections that combine to define the cross-sectional contour of the primary coupling means, and the top disc may be de-cored to obtain the shape of a top ring whereby further material is saved.

The element according to the invention may come in several varieties.

In a first group of varieties, the coupling areas for friction coupling are offset along the periphery of the primary coupling means relative to the coupling areas for snap-lock coupling. In that group, the primary coupling means have radial protrusions that are offset in the periphery direction relative to the coupling areas for friction coupling.

According to one embodiment, the top disc is shaped like an octagon, and the primary locking means are situated on the octagonal top disc outside the inscribed circle of the octagon. By this embodiment the ribs that extend between the top wall and the top disc delimit notches that are in connection with the primary locking means which are situated at the corners of the octagonal top disc. Preferably the ribs carrying the top disc are flush with said inscribed circle whereby friction can be generated between the ribs and the secondary friction means.

According to a preferred embodiment, the radial protrusions on the top disc are each situated between an adjacent pair of ribs, wherein said ribs are situated like a number of cylinder sections that define a number of friction coupling areas on the primary coupling means. In that embodiment, the ribs and the top disk combine to define a primary coupling means that has great visual similarity with the coupling studs on the said known frictional building elements. The difference is merely a number of narrow axial notches that are in connection with primary locking means on said radial protrusions.

In a second number of varieties, the coupling areas for friction coupling are offset relative to the coupling areas for snap-lock coupling in a direction transversally to the top wall. This means in practice at right angles to the top wall, albeit an angled direction is also within the scope of the invention.

Preferably, the secondary coupling means are configured to cooperate frictionally with the top disc on a neighbouring element in a mutually interconnected position, while the element's locking protrusions are configured for snap-lockingly cooperating with the lower edge of the top disc of the neighbouring element.

To achieve interconnectivity with said known elements, the element's secondary coupling means comprise friction-coupling means that are situated at a greater distance from the top disc than the distance of the snap-locking protrusions. In this way it is ensured that said friction-coupling means do not collide with the snap-locking means.

In case of the embodiments wherein the primary friction areas are offset relative to the primary locking means in the peripheral direction, it is obvious that the secondary locking means are situated to each their side of the secondary friction means, seen in a sectional view in parallel with the top wall. However, in the embodiments where said areas are offset relative to each other transversally of the top wall, the particular effect may be obtained, by a corresponding mutual lateral translation, that the secondary locking means do not cause wear to occur on the primary friction means during the interconnection. Thereby the longevity of the elements is prolonged even in case inexpensive kinds of plastics are used that easily undergo cold flow.

According to one embodiment, the secondary coupling means comprise, in the cavity of the element, a number of coupling rails that extend transversally of the top wall and which are in connection with the elastically resilient walls. In that embodiment, the locking protrusions are situated on the coupling rails whose function it is to adjust the distances between the walls of the element and the locking means thereby enabling them to cooperate with the primary coupling means in response to the dimensions and wall thicknesses of elements.

From U.S. Pat. No. 3,005,282, coupling tubes in the element's cavity for cooperating with a neighbouring element's coupling studs are known.

Corresponding coupling tubes are found on the element according to the invention, but they may be configured in several ways and may be eg square or octagonal in cross-section. In accordance with the invention, these coupling tubes may be provided with both secondary friction-coupling means and with secondary snap-locking coupling means.

According to a particular, material-saving embodiment, the latter coupling tube is replaced by a number of coupling legs, whose one side is axially flush with a primary coupling means on the opposite side of the top wall, and wherein said side of the coupling legs is provided with locking protrusions and coupling areas for friction coupling separate therefrom and for cooperation with the primary coupling means on a neighbouring element.

When that embodiment is combined with the top disc being de-cored like a top ring, a combination of maximal material savings and maximal coupling force and minimal or no cold flow is obtained.

The coupling legs may be arranged symmetrically about an axis of symmetry for four adjacent, primary coupling means, but they could also be located anywhere flush with a space between two ribs carrying the top disc. The more coupling legs, the greater the coupling force.

Preferably the locking protrusions have engagement faces with respective engagement angles relative to the wall that carries the locking protrusion, wherein the angles define the coupling and the decoupling forces, respectively. In this way, the forces for interconnection and separation, respectively, can be varied.

As mentioned, the element according to the invention is compatible with known building elements that are based on frictional force. Therefore the invention also comprises varieties that have one or more rows of primary coupling means and corresponding, interior coupling skirt tubes or coupling walls. In case of coupling walls, the compatibility is supported by the coupling wall according to the invention having both an area for friction coupling and one or more locking protrusions to the side of the friction area. In case of coupling tubes, the compatibility is supported, in one embodiment, by the coupling tubes of the invention being, in cross-section, octagonal, and in that the secondary locking means are situated outside the inscribed circle of the octagon, while the friction areas are flush with said circle. According to an alternative embodiment, the compatibility is supported in that the locking protrusions are arranged so high up that they are clear of the known primary locking means.

According to one embodiment of the invention, the decoring in the top ring is dimensioned to correspond to a secondary coupling tube in a down-scaled neighbouring element, whereby the coupling tube is received in the cavity in the interconnected position of the elements. This feature is a further compatibility measure ensuring that a primary coupling means according to the invention can be interconnected with a coupling tube in a neighbouring element which is down-scaled as it is known eg from elements with the trademark DUPLO® and LEGO®, respectively.

When the top disc is de-cored, whereby it appears like a top ring, more dimensioning options are obtained with regard to a certain lateral elasticity of the primary coupling means during the interconnection as such. Following the interconnection, the primary coupling means is elastically relieved whereby cold flow is avoided.

In principle, the invention also comprises a third variety of embodiments, where the areas for friction coupling are situated at a distance from the areas for snap coupling measured in the radial direction. These varieties presuppose de-coring of the top disc and will typically be configured such that the primary friction-coupling means are located on the outside of the primary coupling means, while the primary snap-coupling means are located on the inside of the de-cored primary coupling means. The secondary snap-coupling means will typically be a number of protruding legs within the element; however, this is only practically feasible in case of large elements and not on the scale for which the invention was primarily intended. This third group of varieties will therefore not be subject to further exemplification.

Thus, it will be understood that several varieties of the element according to the invention are fully interconnectable with the known elements having said trade names.

The invention is also an ideal adaptation to the technique of the future, viz 3D production. This is due to the already mentioned low requirements to accuracy, plastics quality and material consumption. And by the element according to the invention being interconnectable with the prior art elements, the children can still use the known elements along with the elements according to the invention, but of course only for as long as the friction force of the known elements is sufficient for yielding a good building and play experience.

From US 2014244018, it is known that children may be given even larger creative challenges in that, by means of 3D technology, they can design their own building elements themselves. This opens up for numerous new designs for interconnection with known building systems. However, in practice, such new opportunities may cause problems to the children. That may happen if, for instance, elements are designed whereby a good play experience presupposes that the coupling force that keeps the elements together exceeds that which can be obtained by the prior art building elements. By the present invention, the coupling force can be adapted to the loads to which the structure is exposed—even without a risk of cold flow.

In practice this could be obtained by the user entering a 3D animation of a coupling which, according to the invention, is a combined friction and snap-lock coupling.

One example includes advanced static structures and constructions that include mechanical transmission, wherein a high torque makes high demands to the elements not being separated during play. Or wherein the users (the children) themselves design ornamental building elements that require a particularly high coupling force relative to the remainder of a model.

In many cases the prior art technique will not be able to deliver a sufficient coupling force for those purposes, but the invention enables that an inclined face on the locking protrusion that fixate the elements relative to each other forms a large angle to the sidewall of the element and entails a considerably larger cohesion force than that which can be obtained by ordinary friction coupling.

The invention is also suitable on a larger scale, eg for constructing playhouses, wherein the elements may be the size of building bricks, and wherein locking means ensure that the elements do not fall apart.

The circumstance that the primary locking means according to the invention are in connection with the notches presents the advantage, from a moulding-technical point of view, that the primary locking means can be injection-moulded. However, this is not a limitation to the element as such being made eg by two-component moulding or multiple-step manufacture. The element according to the invention is suitable for both small building elements and large building elements, eg for playhouses, and it follows that several different manufacturing methods can be relevant.

The invention will now be explained in further detail in the following description with reference to the drawing, wherein:

FIG. 16 shows an alternative to the elements shown in FIGS. 11-14, while

As will appear from the introductory part of the specification, the varieties according to the invention can be divided into a first group, where the snap-lock and friction-coupling areas—or possible friction-coupling areas—are mutually separated in the peripheral directions of the primary coupling means. That variety is described below with reference to FIGS. 1-10.

In another group, the snap-locking and friction-coupling areas—or possible friction-coupling areas—are separated from each other in a direction transversally to the top wall. That variety is described below with reference to FIGS. 11-18.

Combinations of the two above-referenced groups are also within the framework of the present invention, but are not explained in detail below.

It was mentioned above that the invention also comprises a third group of varieties, wherein the areas for friction coupling are situated at a distance from the areas of snap coupling, measured in the radial direction. Examples of this will not be shown.

Figure 1:
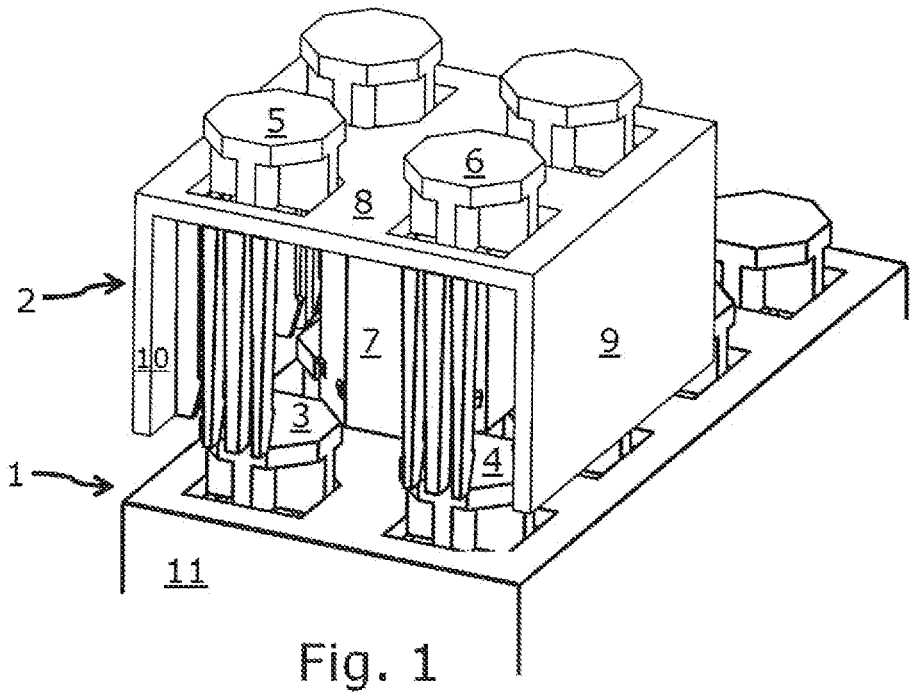
FIG. 1 shows an embodiment of two elements according to the invention, wherein a part of the topmost element has been cut away to show the secondary locking elements according to the invention.

FIG. 1 shows an embodiment of two elements 1 and 2 according to the invention. The elements are shown in a mutual position whereby they can be interconnected by them being towards each other (in the vertical direction in FIG. 1). Parts of the element 2 have been removed to enable that the locking elements according to the invention can be seen, and they will now be described. At a later stage it will be explained how the element according to the invention can be interconnected with a known element via friction coupling.

Each of elements 1 and 2 has two rows of coupling studs, the outermost ones of which being designated by reference numerals 3, 4, 5, and 6. Elements, eg 2, are a hollow body defined by a top wall 8, two sidewalls 9 and 10 and two end walls, wherein the one end wall 11 will appear form the element 1. In the hollow body there is a number of coupling tubes, wherein the element 2 has one single coupling tube 7.

Figure 2:
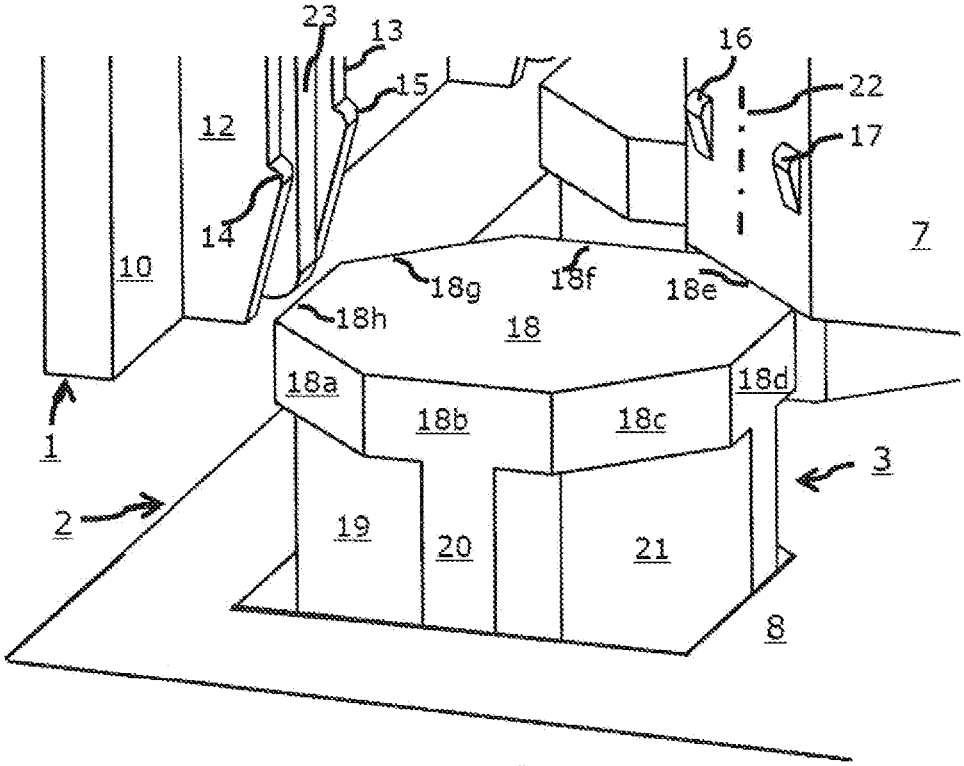
FIG. 2 shows an enlarged section of the same disclosures as FIG. 1.

FIG. 2 shows an enlarged, sectional view of FIG. 1. On the inside of the wall 10, there are two coupling rails 12 and 13, respectively, each of which is provided with a locking protrusion 14 and 15, respectively. The tube 7 has an octagonal cross-section and, on four of its faces, it has other locking protrusions, of which the locking protrusions 16 and 17 are shown in FIG. 2. The coupling stud 3 comprises an octagonal top disc 18 which is connected to the top wall 8 via four radial ribs, where ribs 19, 20, and 21 can be seen.

The octagonal top disc 18 has eight side faces 18*a-h* of same size, the side face 18*e* being flush with that one of the faces of the tube 7 that carries the locking protrusions 16 and 17, while the side face 18*h* is flush with those side faces of the coupling rails 12 and 13 that carry the locking protrusions 14 and 15, respectively.

Figure 3:
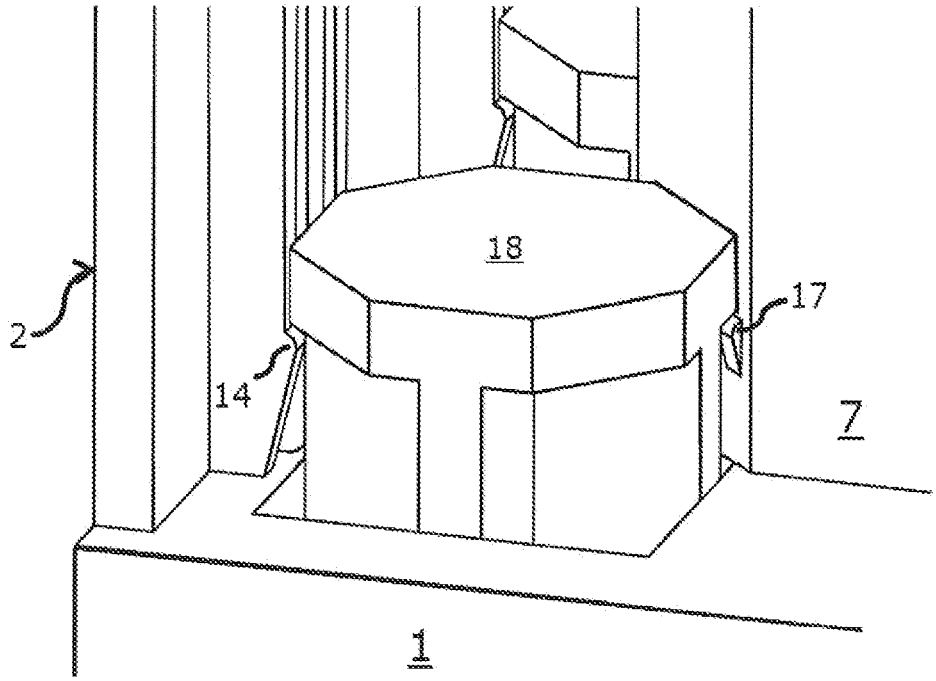
FIG. 3 shows an enlarged section, however now in the mutually interconnected position of the elements.

FIG. 3 shows an enlarged section of the parts shown in FIG. 2 when the elements are assembled. The walls of the tube 7 and the sidewalls 9, 10 of the element are elastically resilient to the effect that the elements can be pressed together to the position shown in FIG. 3, where the locking protrusions 14 and 17 cooperate with the lower edge of the top disc 18 with snap-locking effect. Correspondingly, others, is the locking protrusions 15 and 16 (FIG. 2), will snap-lock below other locations of the top disc and correspondingly for the other coupling studs and coupling walls.

The locking protrusions cooperate with the lower edge of the corners of the corners of the octagonal top disc, and thus the corners serve as primary locking means according to the present invention. The invention also defines that the primary locking means are in connection with notches in the primary coupling means (3, 4, 5 and 6), and two of those notches will appear from the figure, them being defined between ribs 20 and 19 and 21, respectively. Those notches are the ones allowing that the moulding tool's core can delimit/define the primary locking means. By that embodiment, the notches are larger than necessary to the latter end, but the large notches between the ribs also entail large material savings.

According to an embodiment of the invention, the elastic walls and tubes are substantially completely relieved in the snap-locking position, which serves to safeguard against the material being able to cold flow in the locking position. According to an alternative embodiment, the snap lock can be supplemented with a relatively higher friction coupling, side faces 18*e* and 18*h* being pressed towards the tube 7 and the coupling rail 23, respectively, and correspondingly for the other cooperating faces.

Figure 4:
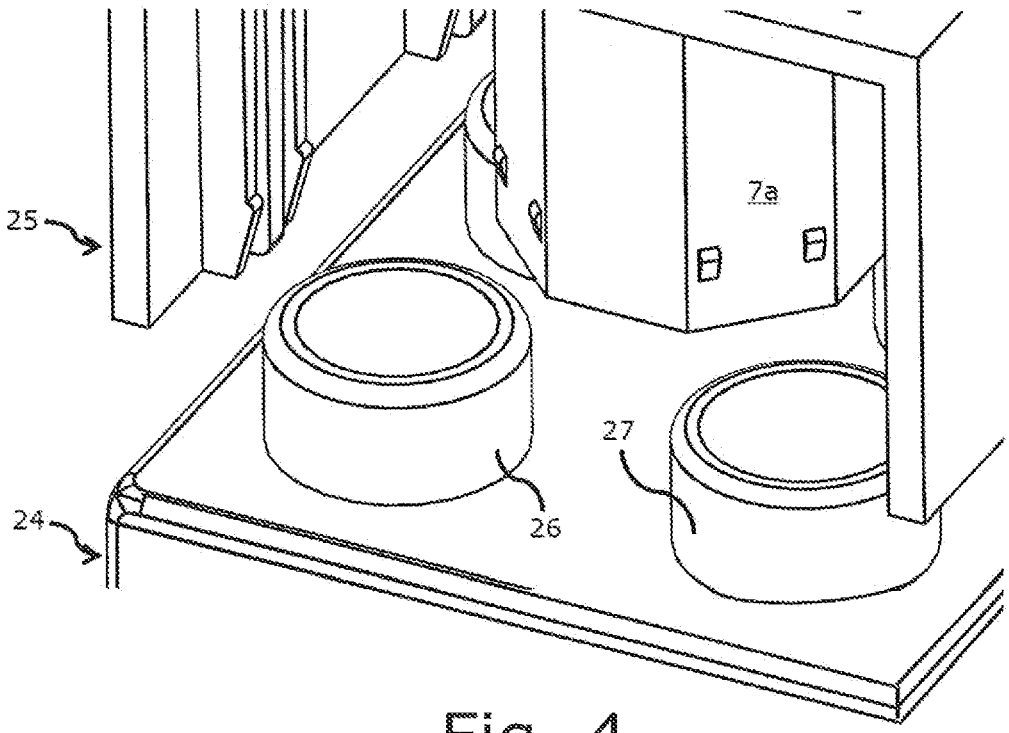
FIG. 4 shows interconnection of a known element with an embodiment of an element according to the invention.

FIG. 4 shows a known element 24 for interconnection with an embodiment of the element 25 according to the invention. The known element 24 has circular coupling studs, eg 26 and 27, wherein the coupling studs are de-cored (see below).

It will be understood that the round coupling stud 26 is capable of frictionally cooperating with the coupling tube 7*a* in an area around the line 22 shown in FIG. 2. For the sake of the frictional coupling, the sidewall of the element is advantageously provided with an additional coupling rail 23 (FIG. 2) which is situated the coupling rails 12 and 13. Correspondingly applies to other cooperating friction areas whereby an element according to the invention can be interconnected with a known element via friction coupling. The friction coupling presupposes that the elastic walls are slightly deformed in the interconnected position, It will consequently be understood that the element according to the invention can cold flow slightly when it is coupled onto the known element throughout a protracted period of time. That will be particularly pronounced in case a cheap plastics material is used. However, this does not prevent the coupling with snap locks according to the invention from still providing a reliable interconnection, albeit the plastics has deformed slightly due to the snap-locking principle according to the invention being very tolerant to the measurements that are critical in case of friction coupling of the known elements. When known elements are friction-coupled, it is therefore necessary to use expensive plastics material, and a lot of it is to be used since the walls need to be thicker. And finally, high demands are made to the tolerances of the manufacturing tools. Since elements of the known type are made in large amounts, it will be understood that the invention enables huge savings while simultaneously the coupling force increases. According to the invention, the coupling force may even be increased when the elements are separated compared to when they are assembled (see the explanation to FIG. 8 below).

The de-cored stud 26 or 27 of the prior art element 24 has the particular advantage that the stud is capable of receiving an annular coupling skirt from a down-scaled building element as it is known eg from the interconnection of two different types of building elements known under the trademarks DUPLO® and LEGO®, respectively.

Figure 5:
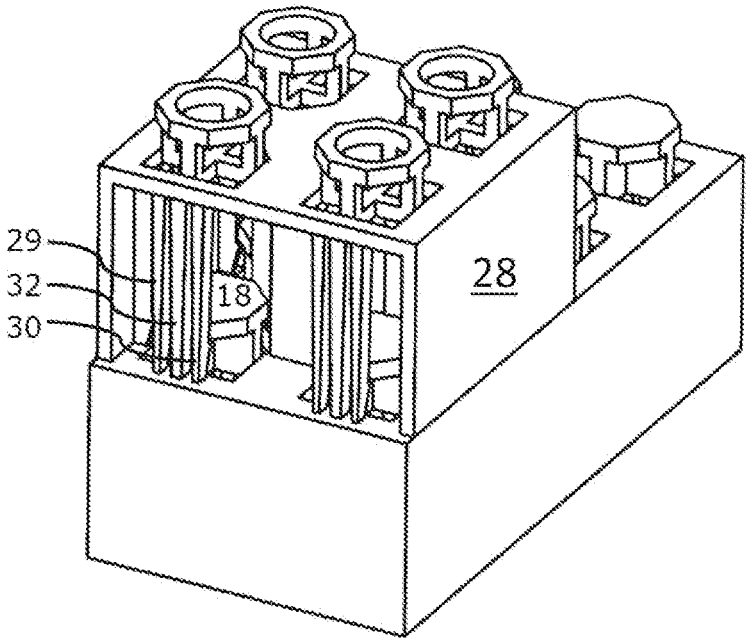
FIG. 5 shows an alternative embodiment of the invention.

FIG. 5 shows an embodiment of the element 28 according to the invention wherein the coupling studs are de-cored like the coupling studs 26 and 27 in FIG. 4. The figure also shows how the locking protrusions on eg the coupling rails 29 and 30 snap-lock down below the top disc 18, while the coupling rail 32 which does not have any locking protrusion is capable of frictionally coupling against the top disc 18 or correspondingly against the round coupling stud, eg 26 in FIG. 4. Correspondingly applies to all other cooperating coupling parts. Based on FIG. 5, one can also get a sense of how much plastics material is saved in the manufacture of the elements according to the invention which makes it correspondingly less expensive and faster to manufacture them.

It was explained already initially how many other advantages that are accomplished by the invention when it is combined with 3D manufacture. It will not be repeated at this point, but in the following some further perspectives of the invention will be explained with reference to FIGS. 6, 7 and 8.

Figure 6:
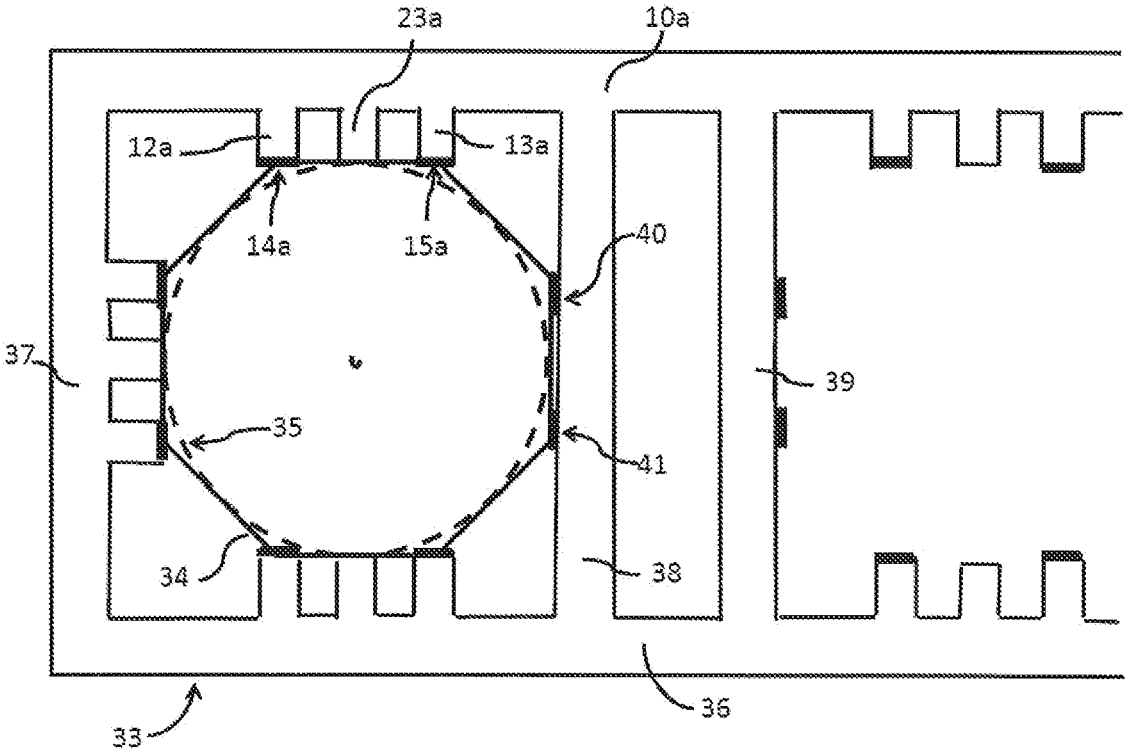
FIG. 6 is a partially sectional view through a third embodiment of the invention.

FIG. 6 is a sectional view through an embodiment of the element 33 according to the invention in parallel with the top wall. The element is of the type having one single row of coupling studs, and the figure will show the octagonal coupling stud 34 on an underlying building element which is interconnected with the element 33. The inscribed circle 35 of the octagon is also shown.

Reference numerals 10*a*, 12*a*, 13*a*, 14*a*, 15*a*, and 23*a* in FIG. 6 may be compared to the corresponding reference numerals (without index) in FIG. 2, and it will be understood that there are corresponding, cooperating parts on the inside of the side face 36 and the end face 37, respectively. Known prior art building elements with one single coupling stud usually only have guide pins in the hollow body, but according to a preferred embodiment of the invention, there are transverse walls, eg 38 and 39, that are elastically resilient and are provided with locking protrusions 40 and 41 that are configured to be able to snap-lock against the underside of eg the top disc 18 in FIG. 2, preferably such that the transverse wall 38 is elastically relieved in the mutually interconnected position.

The inscribed circle of the octagon corresponds to a coupling stud on a known element, which is configured for friction coupling. It will therefore be understood that friction coupling can be provided on the wall 38 centrally between the locking protrusions 40 and 41, and on the coupling rail 23*a* and on the corresponding coupling rails on the wall 36 and 37. This means that, for as long as the locking means are situated outside the inscribed circle 35 of the octagonal coupling stud, the combination of snap-locking means and friction-coupling means will not collide with each other, whereby the compatibility between the elements according to the invention and the known elements is ensured.

Figure 7:
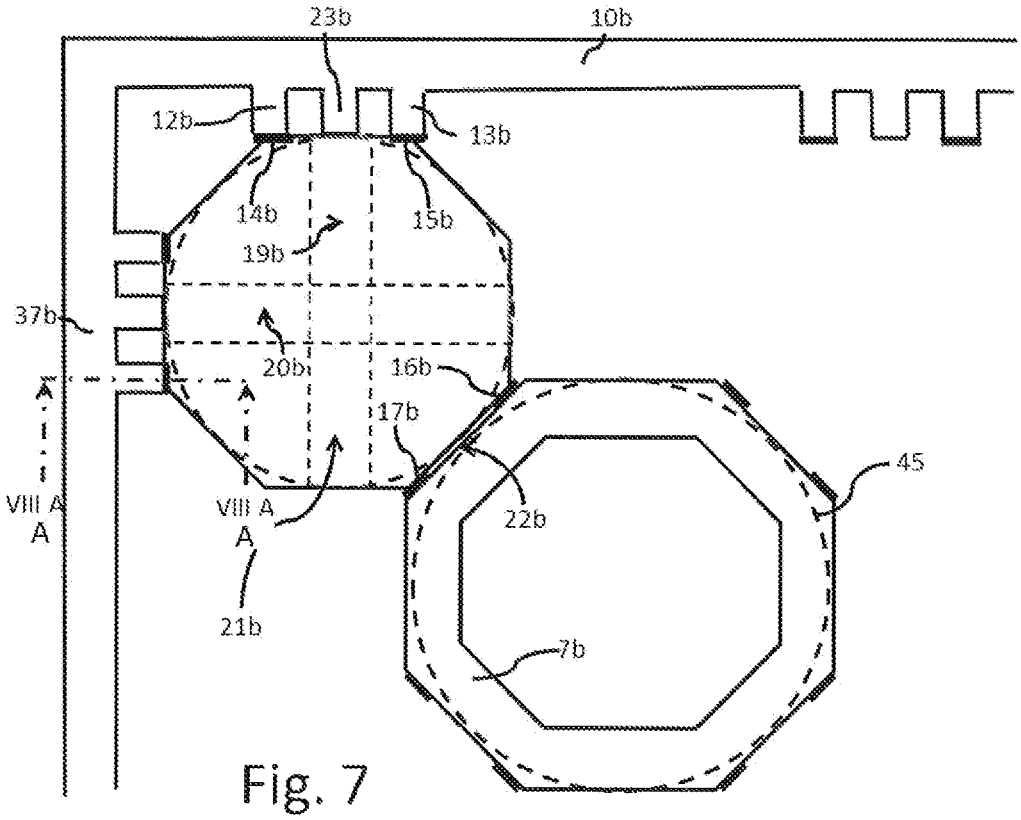
FIG. 7 is a partially sectional view through a fourth embodiment of the invention.

FIG. 7 shows a section through an element with several rows of coupling studs, typically two rows. The reference numerals in FIG. 7 with index "b" can be compared to the reference numerals with index "a" in FIG. 6 or without index in FIG. 2.

The difference compared to FIG. 6 is first and foremost that the element now has coupling skirts 7*b* that are configured to cooperate with a coupling stud on a neighbouring element. According to an advantageous embodiment of the invention, the coupling studs 7, 7*b* have an octagonal cross-section, and the locking protrusions 16*b* and 17*b* are arranged outside the inscribed circle 45 of the outer contour to the octagonal coupling skirt 7*b*. This means that the element in FIG. 7 is capable of providing friction coupling against the cross-sectionally circular coupling skirts of a known element in the area 22*b* in FIG. 7 (corresponding to the contact line 22 in FIG. 2).

Figure 8:
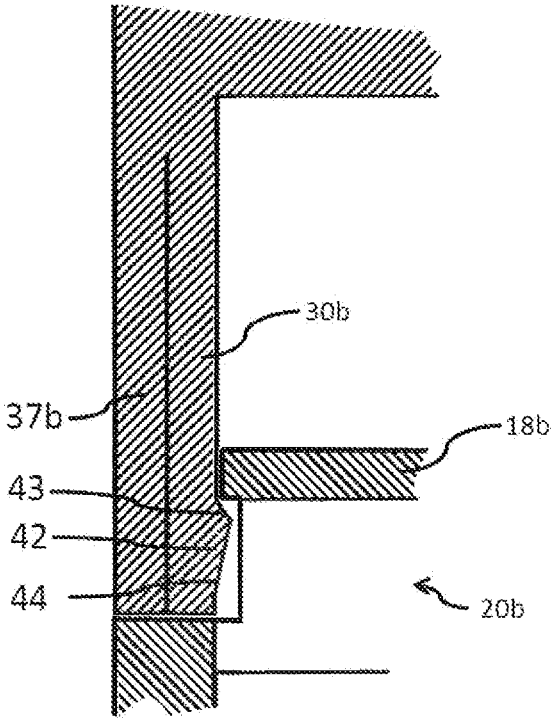
FIG. 8 is a vertical section through FIG. 7 along the line A-A.

FIG. 7 shows, like FIG. 6, an underlying octagonal coupling stud for interconnection with the element shown in a sectional view in FIG. 7, compare with the sectional view in FIG. 8. At 19*b*, 20*b*, and 21*b*, a dotted line shows ribs that correspond to ribs 19, 20 and 21 in FIG. 2. It will be understood that the end edges of the ribs are capable of cooperating frictionally with the coupling rails 23, 23*a* and 23*b* and correspondingly and/or with a known coupling stud which has a circular cross-section.

The element according to the invention can thus be interconnected with other elements of the same kind or of known kind where one is able to control the magnitude of friction force.

By the embodiment shown in FIG. 7, it is demonstrated how an element according to the invention can be interconnected with a known element via friction coupling or by another element according to the invention via a snap-coupling, or via a combination of those coupling principles. As explained in the context of FIG. 6, this is accomplished in that the snap-locking means according to the invention cooperate outside the areas where friction coupling could be provided.

FIG. 8 shows a vertical section A-A through FIG. 7. The one locking protrusion 42 sits on a coupling rail 30*b* (corresponding to 30 in FIG. 5) which is in connection with the wall 37*b*, and the locking protrusion has two inclined faces 43 and 44, respectively. In the shown interconnected position, the locking face 43 cooperates with the lower edge of top disc 18*b*, which corresponds to 18 in FIG. 2. It will appear that the face 43 is steeper than the face 44 (relative to the wall 37*b*), and this means that it is easier to interconnect the elements than it is to separate them.

Figure 9:
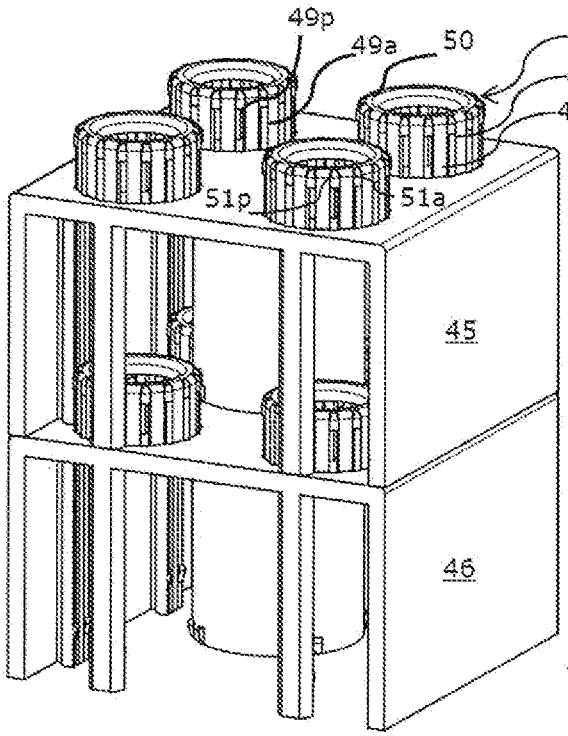
FIGS. 9 and 10 show a section through an element according to an advantageous embodiment of the invention, seen in an inclined, perspective view from above and from below, respectively.
Figure 10:
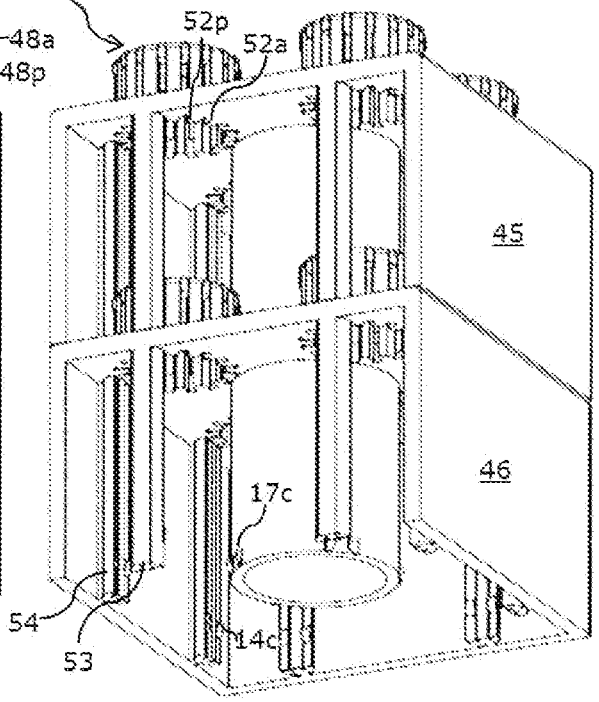

FIGS. 9 and 10 show an advantageous embodiment of the invention where the friction- and snap-coupling means are situated at a distance from each other in the peripheral direction of the primary coupling means, and wherein large material savings are obtained as well as a high degree of visual similarity with building elements that already exist in the market.

The elements 45 and 46 are shown assembled, inclined from above in FIG. 9 and inclined from below in FIG. 10. The coupling principles are the same as were explained in the specification above, to which reference is consequently also made below.

Figure 13:
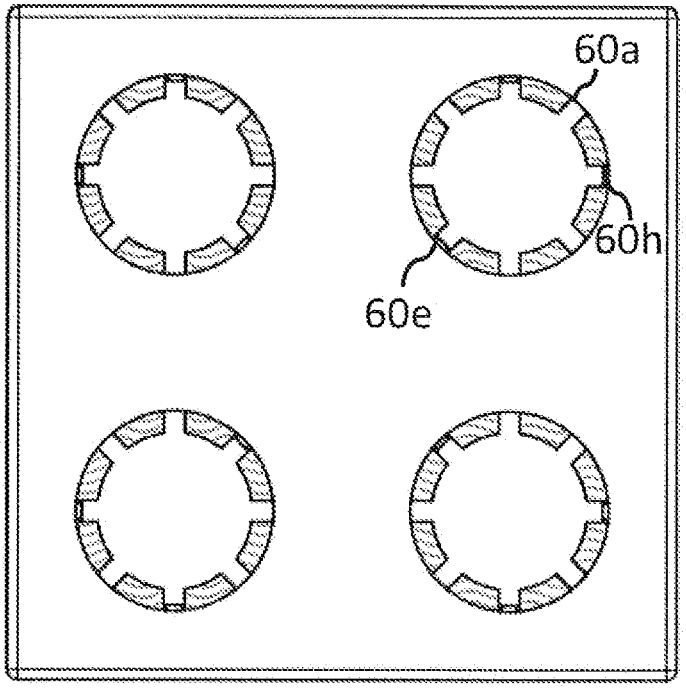
FIG. 13 is a sectional view as shown by FIG. 10.

Four primary coupling means (coupling studs) 47 are shown, each of which is defined by 16 ribs 48*a-p* that are cylindrically-sectionally shaped and combine to constitute a cylinder with 16 notches 49*a-p*. In a section in parallel with the top wall, the ribs will look as it is shown in FIG. 13 which shows another embodiment with eight ribs. The ribs 48 are, at the top, in connection with a top ring 50, and the notches 49 are coherent with radially protruding locking edges 51*a-p* which, in that embodiment, constitute the primary locking means.

The locking edges correspond functionally to the corners on the octagonal top wall (see above) and protrude only slightly relative to the inscribed circle of the octagon, since it must be possible to provide friction coupling against the ribs 48, see the explanation above. Therefore, the notches 49 are a necessary consequence of the moulding tool that delimits the locking edges 51. The U-shaped holes 52*a-p* in the top wall reflect that the radially protruding locking edges 51 are rounded.

As mentioned, the locking edges correspond to the corners of the octagonal top wall, see above, and therefore the secondary locking means and the secondary friction-coupling means of the elements 45 and 46 may be configured completely as explained in connection with FIGS. 1-8, see eg 14*c* and 17*c* (cf. FIG. 3). A change compared to earlier is that the coupling rails, eg 12, 13 and 23 (FIG. 2) are integrated such that, in cross-section, they have the shape of a coupling head 53 which is connected to the sidewalls via a coupling rail 54. The coupling head has three branches, the middlemost one of which is configured for friction coupling, while the outermost ones are provided with locking protrusions, cf. the explanation above. That construction entails both a uniform material thickness (cooling in the moulding tool) and material savings.

The construction used for the primary coupling means 47 in FIGS. 9 and 10 thus entail an efficient combination of friction coupling and snap-lock coupling while simultaneously they are visually related to building elements that are wide-spread in the market.

In the following, embodiments will be described wherein the friction-coupling areas and the snap-lock coupling areas are situated at a distance from each other seen at right angles to the top wall.

Figure 11:
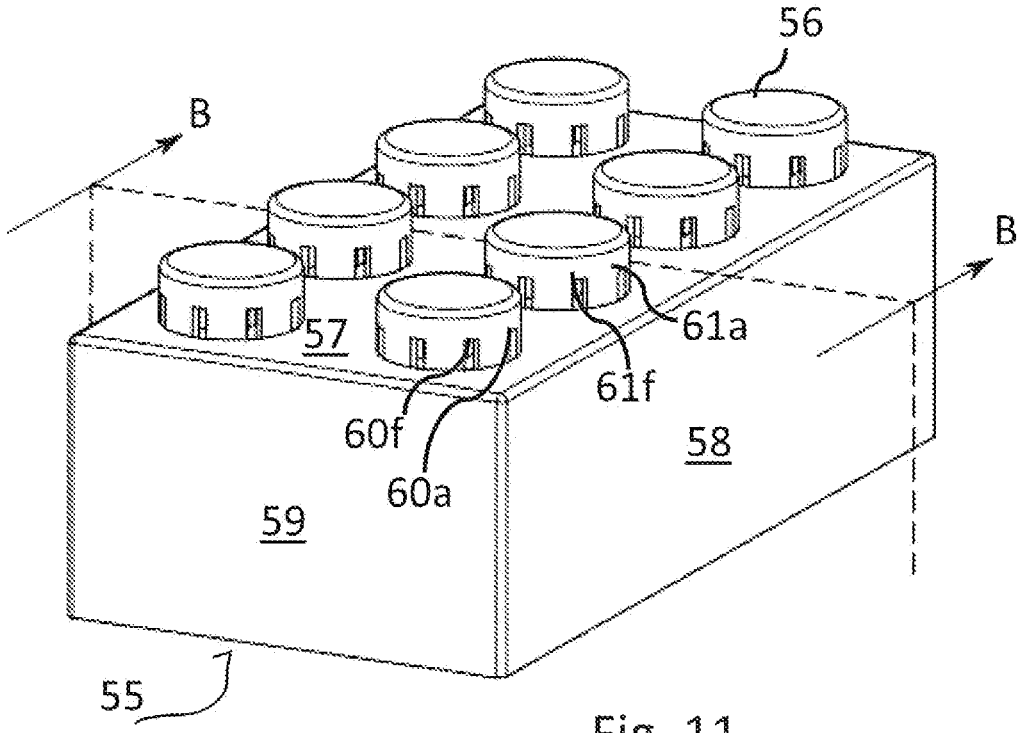
FIG. 11 shows an alternative embodiment of the element according to the invention which bears a strong visual resemblance to elements widely used worldwide.

FIG. 11 shows one such embodiment 55 for the element according to the invention. On the top face, the element has two by four primary coupling means in the shape of coupling studs 56 that are in connection with a top wall 57. From the top wall 57, a number of walls extend in a direction opposite of the studs, eg sidewalls 58 and end walls 59 defining a cavity. The coupling studs 56 are configured for being able to cooperate with complementary coupling means in the cavity of a corresponding element, the element being downwardly open whereby it can be injection-moulded.

In the shown embodiment, each of the coupling studs has a number, eg eight, of notches that are designated by 60*a-f*. The notches 60 are, according to the invention, in connection with primary locking means 61*a-f* in the form of locking edges that delimit the notches upwardly whereby it is possible to provide the locking edges by injection moulding. The notches 60 also serve to receive complementary locking protrusions 83-86 in the cavity of a corresponding element (as it will appear from the following FIGS. 14, 15) and associated explanation), and the locking protrusions are dimensioned such that they can snap-lock against the primary locking means 61 that are situated eg at half the height of the studs. This leaves the studs—at a height above said locking edges—completely like the studs of the prior art elements that are widely used throughout the world under the trademark LEGO®. It is consequently possible to couple the latter, known element on top of the element shown in FIG. 11, where the coupling force is based on friction force. However, when the elements according to FIG. 11 are mutually interconnected, a substantially higher coupling force can be obtained as a consequence of the snap-lock coupling between the locking protrusions 83-86 and the locking edges 61*a-f*. According to the invention, the locking protrusions are substantially elastically relieved in the interconnected position whereby cold flow is avoided.

The snap lock supplements or may replace the friction force and consequently reduces the requirements to plastics types, the wall thickness, and the accuracy of the tools, whereby the element becomes more inexpensive to manufacture.

It is noted that, according to the invention, it is not a requirement that said walls are side and end walls that sit at right angles to the top wall. Therefore, the invention is also ideal as coupling means in connection with 3D-manufactured elements as it is described in eg US 2014244018.

In the context of FIGS. 12-18, various details and varieties with regard to the element shown in FIG. 11 will now be described.

Figure 12:
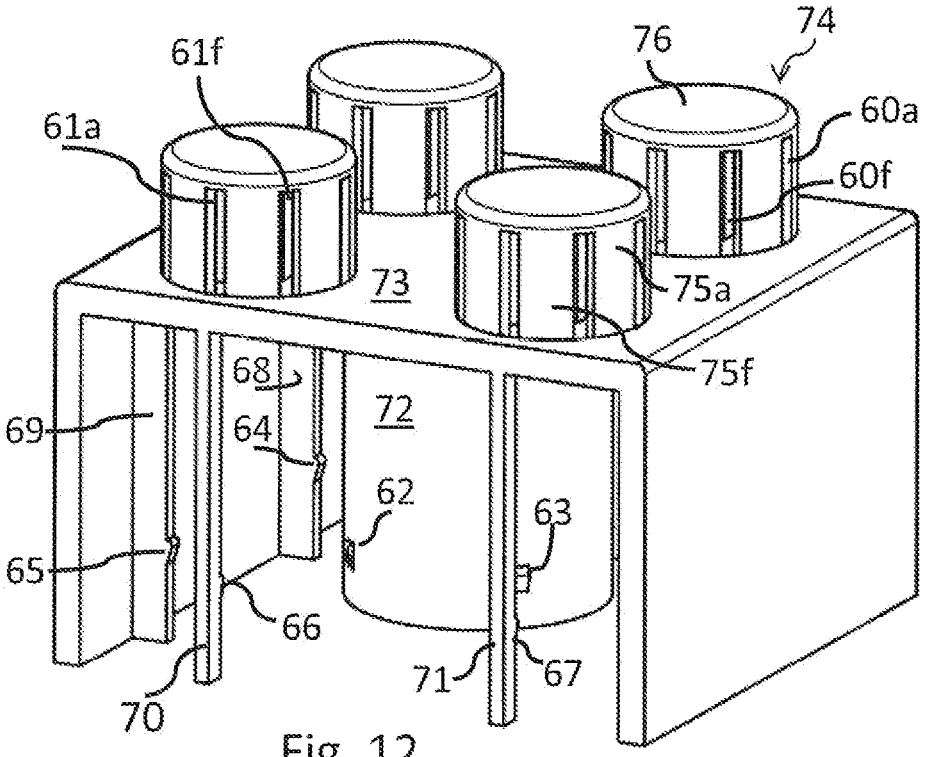
FIG. 12 is a sectional view through an element like the one shown in FIG. 11, seen as the section B-B.

From FIG. 12, it will appear that the secondary coupling means comprise locking protrusions 62-67 and more that do not appear from the figure. The locking protrusions are arranged on respective coupling rails 68-71 (along with others that do not appear). In the cavity of the element, a coupling skirt 72 is also present that is provided with locking protrusions, eg 62, 63. The function of the coupling rails is to adapt the distance between the outer walls of the element and the locking protrusions thereby enabling them to cooperate with the primary locking means 61*a-f* at the top of the slots 60*a-f* and for dimensioning the elasticity of the locking protrusions 62-67.

It should be mentioned that the locking protrusions 62, 63 are at the same height as the locking protrusions 64-67, but that it appears differently in the figure, due to the coupling skirt 72 not extending as far away from the top wall 73 as the side and end walls of the element.

FIG. 13 shows a section in parallel with the element's top wall 73 through the primary coupling means 74. The notches 60 in the studs 56 will now appear more clearly, and from FIG. 12 it will appear that the notches 60 are comparatively longer than they are in FIG. 11.

Studs 74 in FIG. 12 are substantially cylindrical and are defined by eight curved ribs 75*a-f*, that are connected to each other at the top by means of a top disc 76 (see FIG. 12). That embodiment of the primary coupling means according to the invention enables—if desired—a certain flexibility of the stud in the lateral direction which—if necessary—could compensate for the locking protrusions exhibiting slightly less elasticity when they, as shown in FIG. 12, are lifted slightly clear of the bottom of the element, cf. the explanation given in the context of FIG. 9.

Figure 14:
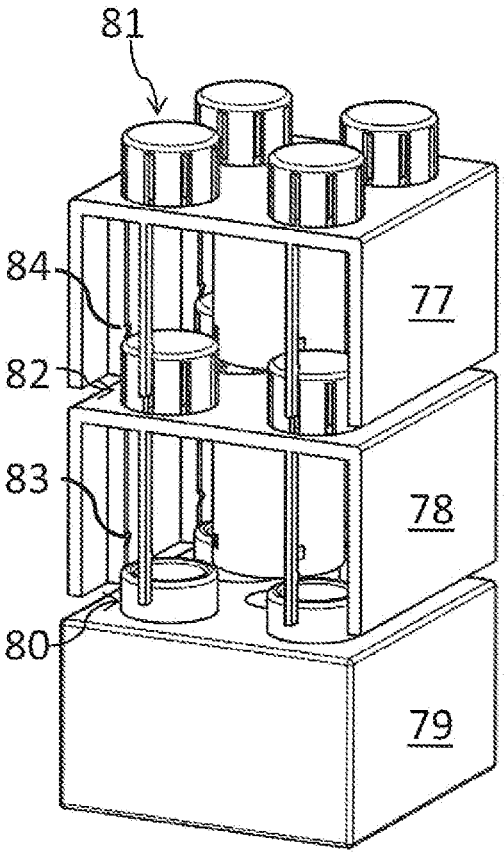
FIG. 14 shows two of the elements of FIG. 12 and a known element at the bottom, in separated state.

FIG. 14 shows two elements 77 and 78 and a known element 79 which are all separated from each other. The known element has coupling studs 80 that are slightly lower than the studs 81 and 82, and correspondingly all the locking protrusions, eg 83, 84 are raised a distance from the bottom of the element.

Figure 15:
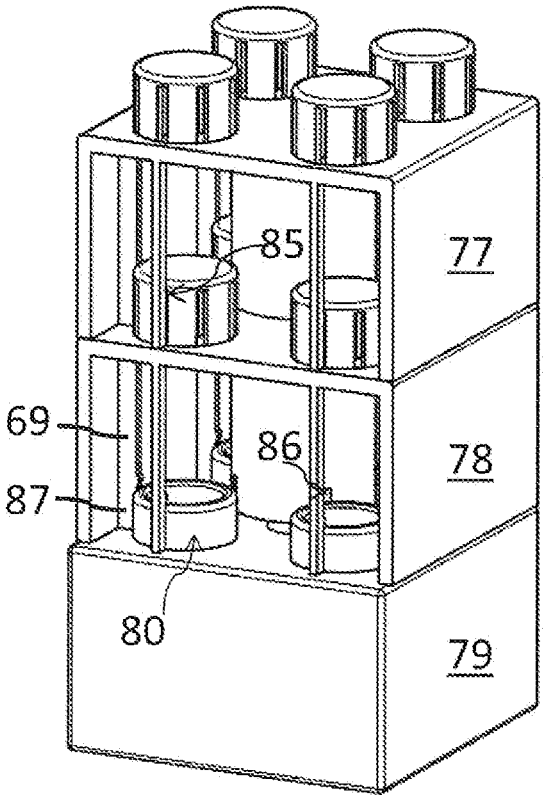
FIG. 15 shows two of the elements shown in FIG. 12 and a known element at the bottom, in assembled state.

In FIG. 15, the elements shown in FIG. 14 are interconnected, and it will appear that the locking protrusions (eg 84, 85) are now received in the notches of the respective studs whereby, according to the invention, they are substantially elastically relieved. In turn, it will also appear from FIG. 15 that the locking protrusions, eg 83, 86, are only just clear of the height of the studs 80. If they were not, the locking protrusions 83, 86 (and other corresponding ones) would entail an undesired elastic biasing of the side walls of the element via the associated coupling rails (see 68-71, FIG. 12). Elements 77, 78 are therefore completely compatible with the element 79.

The elements 78 and 79 are kept together by a friction force, the lowermost part 87 of the coupling rails 69 (and corresponding ones) being dimensioned to be able to frictionally couple with the stud 80 (and corresponding ones). Should it be a requirement that the coupling studs according to the invention cannot be slightly taller than the known coupling studs, this could be achieved by obviating the locking protrusions 83-86 (and corresponding ones), and the element 78 would, in that case, serve as an adaptor element.

Figure 16:
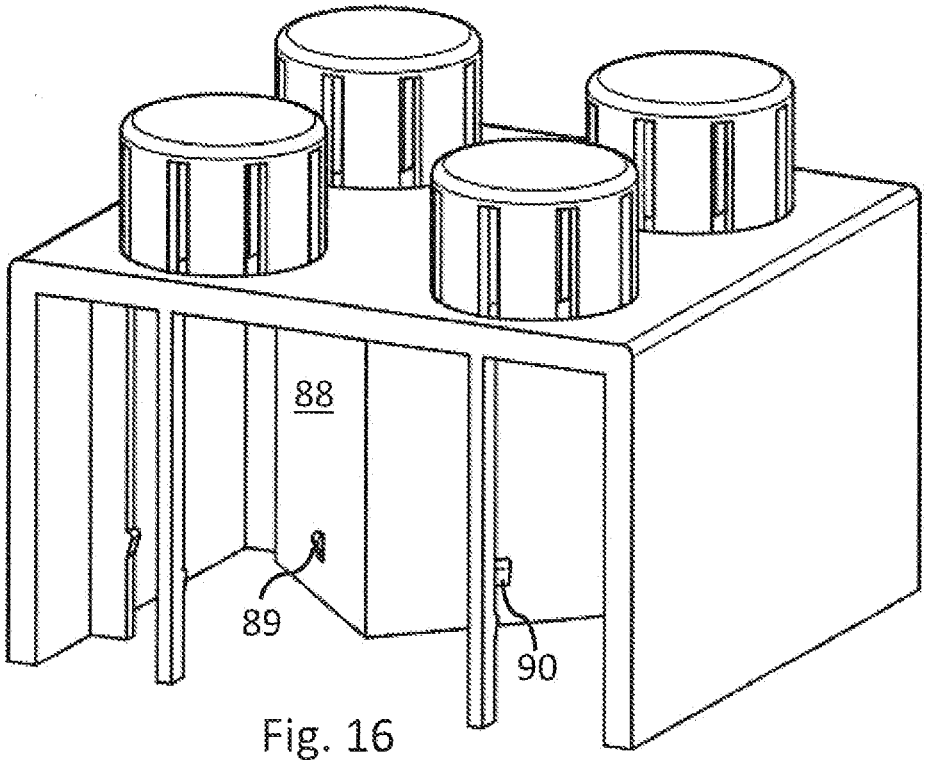

FIG. 16 shows a variety wherein the coupling skirt 72 in FIG. 12 has been replaced by a skirt 88 having a square cross section which is provided with locking protrusions 89, 90 (and more). The square side faces are more elastically movable than the round skirts 72, or at least this variety enables far more options for dimensioning, meaning that the desired elastic forces are accomplished.

The elastic movability of the locking protrusions also serves another function apart from being able to snap-lock with the primary locking means. When the element according to the invention is to be discharged from a moulding tool, the external tool is first removed. When the internal tool is subsequently removed, it must be able to pass by the locking protrusions that are consequently to be able to move elastically for a small distance which is precisely possible when the external tool has been removed first. It may occur—in case of certain dimensions—that the coupling skirt, eg 72 in FIG. 12, is too inelastic for that purpose, and here the square coupling skirt 88 in FIG. 16 will readily permit the latter elastic movability. In case a round coupling skirt is preferred, it is an option to slit it axially and hence allow for said elastic movability.

Figure 17:
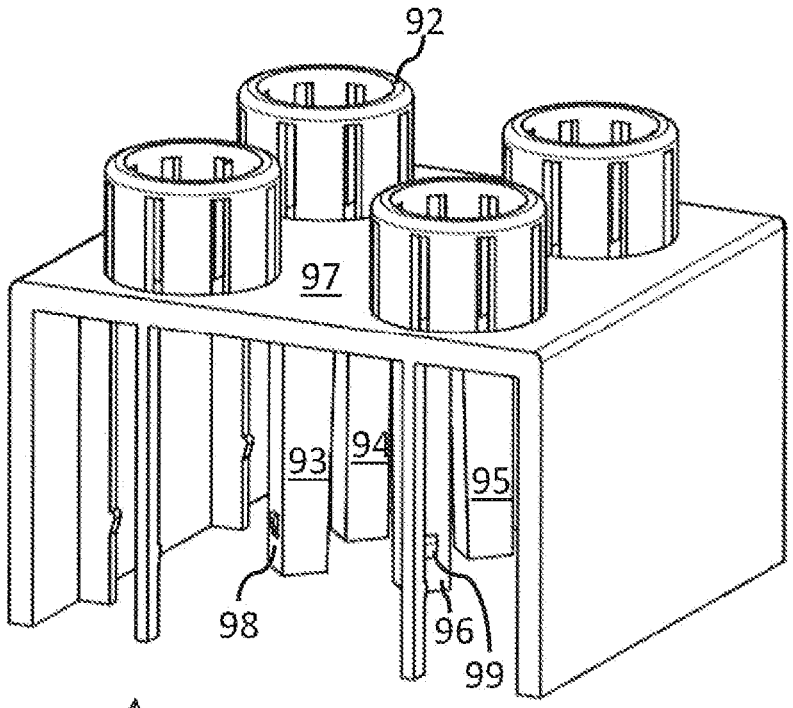
FIGS. 17 and 18 show yet another embodiment that provides additional large material savings.
Figure 18:
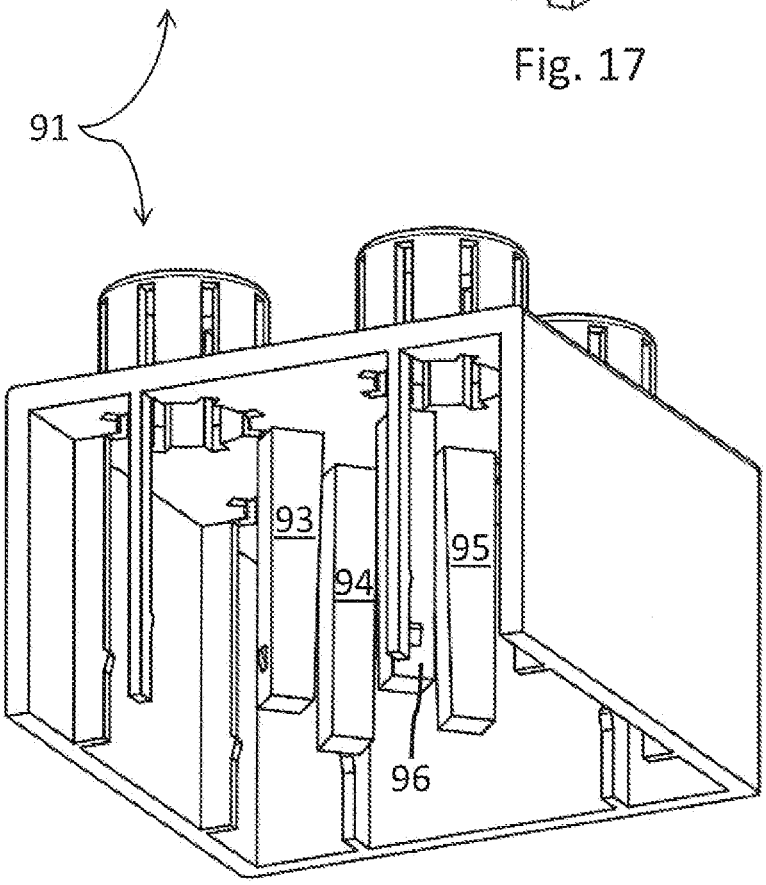

FIG. 17 shows a section through an embodiment 91 of the element according to the invention. That element excels in particular in a low material consumption and in that there are several ways in which it is possible to provide precisely those elastic properties that are necessary for the given purpose.

Firstly, it will appear that top discs 76 (FIG. 12) have become top rings 92, due to the entire stud being de-cored whereby the same effect can be obtained as explained above in case of interconnection of elements of the type LEGO® and DUPLO®.

The de-coring also means that the ribs 75, the notches 60 (from FIG. 12) and the top ring 92 can be dimensioned such that the coupling means 74 exhibit a certain elasticity in directions in parallel with the plane of the top ring, and thereby compensate for the locking protrusions 62-67 having less elastic movability due to their being situated more closely to the top wall than was the case with preceding embodiments.

Secondly, each of the coupling skirts, eg 72 and 88, are replaced by four coupling legs 93-96 that are in connection with the element's top wall 97 and extend into the cavity of the element. The legs are provided with respective locking protrusions, eg 98 and 99, on that side of the coupling legs that are tangent to the geometrical extension of the coupling studs down into the cavity of the element. This will appear more clearly from FIG. 18 which shows the element from FIG. 17, seen in a perspective view from below. It will readily be understood that the secondary coupling means on the element 91 are configured and function exactly as described in the context of FIGS. 12-15.

It will be understood that it is an option to arrange more coupling legs than shown. In particular for large building elements, eg for building playhouses, it may be an option to increase the coupling force by means of a larger number of coupling legs. The use of coupling legs also means a substantial increase in the scope for variations of the element according to the invention.

In particular in case of 3D manufacture of special elements, it is important to have many options available for dimensioning and configuring the coupling means.

It was emphasized above that the invention is also future-oriented towards 3D manufacture, but it is important to note that the increased holding force is just as relevant in connection with known, injection-moulded elements that are to be assembled to a model and which are, in some places, critical with regard to the risk of the model breaking apart. This can also be expressed such that the increased holding force in case of the element according to the invention opens new possibilities for the children's/designer's imagination, while simultaneously the children can use their old, ie known, friction-coupling elements elsewhere in the model where coupling force is not critical.

All of these advantages are obtained because the primary coupling mens comprise primary locking means, and because, in the box-shaped hollow body, there are secondary locking means, wherein the primary locking means are configured for snap-lockingly cooperating with the secondary locking means on a neighbouring element in some locking areas that are situated outside said friction areas, and because the secondary locking means are elastically resilient in directions in parallel with the top face of the building element, and are substantially elastically relieved in the locking position.

Likewise, the reduced consumption of plastics and low requirements to the quality of plastics material mean a reduction of the costs of manufacture, also for injection-moulded elements according to the invention. And, finally, it should be added the injection-moulding tools for the element according to the invention are very inexpensive to manufacture due to the smaller requirements to tolerances.

The invention claimed is:

1. A toy building element in the shape of a box-shaped hollow body which is defined by a top wall and by walls extending from the one side of the top wall, and wherein, from the opposite side of the top wall, primary coupling means extend that have predetermined contours and location patterns, and wherein, in the box-shaped hollow body, secondary coupling means are provided that are configured for cooperating with the primary coupling means on a corresponding building element in a number of coupling areas, wherein the secondary coupling means comprise secondary locking means in the form of locking protrusions on the walls at a distance from the top wall for snap-locking cooperation in snap-locking areas with primary coupling means on said corresponding building element in a mutually interconnected position, wherein the locking protrusions are substantially elastically relieved when the element is interconnected with said corresponding building element;

wherein the coupling areas comprise coupling areas that are configured for friction coupling, wherein the coupling areas for friction coupling are situated at a distance from the coupling areas for snap-lock coupling;

the snap-lock coupling is provided by means of, on the one hand, said locking protrusions, and, on the other, primary locking means that are situated at the end of notches in the primary coupling means, said notches extending through the top wall essentially perpendicularly to the top wall.

2. A building element according to claim 1, wherein the notches are defined between a number of ribs that extend between the top wall and a top disc that constitute the top of the primary coupling means, the ribs being situated on or within the axial extension of the top disc's contour.

3. A building element according to claim 2, wherein the top disc is de-cored as a top ring.

4. A building element according to claim 2, wherein the primary locking means are constituted by radial protrusions on the top disc.

5. A building element according to claim 4, wherein said ribs extend radially; that the top disc's contour is octagonal; and that the notches that are in connection with the primary locking means are defined between the radial ribs.

6. A building element according to claim 5, wherein the primary locking means are located on the lower edge of the octagonal top disc outside an inscribed circle of the octagon.

7. A building element according to claim 6, wherein said radial ribs are axially flush with the inscribed circle of the octagonal top disc.

8. A building element according to claim 4, wherein each of the radial protrusions is in connection with the notches in the primary coupling means that are situated between an adjacent pair of ribs, wherein the ribs are situated like a number of cylinder sections that define the friction-coupling areas on the primary coupling means.

9. A building element according to claim 4, wherein the top disc's contour is circular.

10. A building element according to claim 4, wherein the secondary coupling means are configured for cooperating frictionally with the top disc on a neighbouring element in a mutually interconnected position; and wherein the element's locking protrusion is configured for snap-lockingly cooperating with the lower edge of the neighbouring element's top disc.

11. A building element according to claim 10 and for interconnection with another building element having primary coupling means, wherein the element's secondary coupling means comprise friction-coupling means that are situated at a larger distance from the top disc than the locking protrusions, and which are configured for being able to couple frictionally with the primary coupling means of the other building element.

12. A building element according to claim 1, wherein the coupling areas for friction coupling are offset along the periphery of the primary coupling means relative to the coupling areas for snap-lock coupling.

13. A building element according to claim 1, wherein the coupling areas for friction coupling are offset relative to the coupling areas for snap-coupling in a direction transversally to the top wall.

14. A building element according to claim 1, wherein the secondary coupling means in the cavity of the element comprise a number of secondary coupling rails that extend transversally of the top wall, and which are in connection with the elastically resilient walls; and wherein locking protrusions are provided on the coupling rails.

15. A building element according to claim 1, wherein the secondary coupling means comprise coupling tubes that extend from said one side of the top wall and which are located symmetrically about an axis of symmetry for four adjacent, primary coupling means; wherein, on the walls of the coupling tube, locking protrusions and coupling areas are provided at a distance from the locking protrusions that are configured for friction coupling for cooperation with the primary coupling means on a neighbouring element.

16. A building element according to claim 15, wherein the coupling tube is square in cross section.

17. A building element according to claim 15, wherein the coupling tube is octagonal in cross section.

18. A building element according to claim 1, wherein the walls that extend from the one side of the top wall, comprise coupling legs whose one end is axially flush with a primary coupling means on the opposite side of the top wall; and wherein said side of the coupling legs is provided with locking protrusions and coupling areas separated therefrom that are configured for friction coupling for cooperation with the primary coupling means on a neighbouring element.

19. A building element according to claim 1, wherein the locking protrusions have engagement faces with respective engagement angles relative to the wall that carries the locking protrusions, where the angles define the coupling and the decoupling forces, respectively.

20. A building element according to claim 1, wherein the element is made by a layered structure according to the same principle as applies for 3D copying.

21. A building element according to claim 1, wherein the building element comprises parts that are configured for engagement with dissimilar types of building elements by friction coupling.

22. A building element according to claim 20, wherein the building element comprises ornamental parts.

* * * * *